US010957180B2

(12) United States Patent
Levine

(10) Patent No.: US 10,957,180 B2
(45) Date of Patent: Mar. 23, 2021

(54) CONFINED SPACE FAILSAFE ACCESS SYSTEM

(71) Applicant: Robert Levine, Port Jefferson, NY (US)

(72) Inventor: Robert Levine, Port Jefferson, NY (US)

( * ) Notice: Subject to any disclaimer, the term of this patent is extended or adjusted under 35 U.S.C. 154(b) by 0 days.

(21) Appl. No.: 15/971,795

(22) Filed: May 4, 2018

(65) Prior Publication Data

US 2018/0330595 A1 Nov. 15, 2018

Related U.S. Application Data

(60) Provisional application No. 62/505,636, filed on May 12, 2017.

(51) Int. Cl.

| | |
|---|---|
| ***G08B 21/14*** | (2006.01) |
| ***G08B 17/10*** | (2006.01) |
| ***G08B 25/14*** | (2006.01) |
| ***G08B 17/12*** | (2006.01) |
| ***G08B 27/00*** | (2006.01) |

(52) U.S. Cl.

CPC ..... *G08B 21/14* (2013.01); *G08B 17/10* (2013.01); *G08B 17/125* (2013.01); *G08B 25/14* (2013.01); *G08B 27/005* (2013.01)

(58) Field of Classification Search

None

See application file for complete search history.

(56) References Cited

U.S. PATENT DOCUMENTS 3,960,495 A 6/1976 Tantram
4,824,076 A * 4/1989 Ward ..... A62B 1/14 254/254
4,892,170 A * 1/1990 O'Donnell ..... E06C 1/34 182/100
5,331,310 A 7/1994 Stetter et al.
5,382,943 A * 1/1995 Tanaka ..... G08B 13/19619 340/500
5,608,171 A * 3/1997 Hunter ..... G01F 1/363 73/215

(Continued)

FOREIGN PATENT DOCUMENTS

CA 2211476 1/1998
CN 2849859 Y 12/2006

(Continued)

OTHER PUBLICATIONS

Scott Deitchman, M.P.H., M.D.; HETA 98-0020; Carbon Monoxide Intoxication and Death in a Newly Constructed Sewer Manhole; Centers for Disease Control and Prevention, National Institute for OSHA, 1600 Clifton Rd., Atlanta Georgia, 30333; Oct. 30, 1997; 23 pages.

(Continued)

*Primary Examiner* — Benyam Haile
*Assistant Examiner* — Muhammad Adnan
(74) *Attorney, Agent, or Firm* — Alfred M. Walker

(57) ABSTRACT

A method and safety device for use in accessing confined spaces that incorporates atmospheric safety monitoring and alarm annunciation into a physical access device/mechanism for the purpose of preventing the human confined space entrant from entering a confined space containing a hazardous atmosphere.

24 Claims, 12 Drawing Sheets

(56) References Cited

U.S. PATENT DOCUMENTS 5,684,250 A * 11/1997 Marsh ..... G01F 1/002 702/100
5,771,004 A * 6/1998 Suppelsa ..... G01N 33/0062 340/521
6,053,030 A 4/2000 Whynall et al.
6,611,204 B2 8/2003 Schmurr
6,802,084 B2 * 10/2004 Ghertner ..... E03D 1/00 340/605
6,839,636 B1 * 1/2005 Sunshine ..... B82Y 15/00 422/82.01
7,002,481 B1 * 2/2006 Crane ..... G08B 25/08 324/207.2
7,221,282 B1 * 5/2007 Ross ..... G08B 21/182 340/603
7,233,252 B1 * 6/2007 Hardin ..... G01F 1/002 340/603
7,378,954 B2 * 5/2008 Wendt ..... G01T 1/026 340/539.11
7,423,541 B2 * 9/2008 Miller ..... B67D 1/0871 340/539.22
7,598,858 B2 * 10/2009 Quist ..... G08B 21/12 340/531
8,386,303 B2 * 2/2013 McKinney ..... G06Q 10/06 705/7.41
8,400,317 B2 3/2013 Johnson, Jr. et al.
8,493,223 B2 * 7/2013 Zadnikar ..... G08B 13/19641 340/5.2
8,522,487 B2 * 9/2013 Whiting ..... E05B 47/02 52/19
8,840,841 B2 9/2014 Roberts
9,134,284 B1 9/2015 Loughlin
9,311,805 B2 4/2016 Zishaan
9,371,727 B2 * 6/2016 Hudson ..... E21B 47/042
9,520,042 B2 12/2016 Eck
9,721,456 B2 * 8/2017 Thurlow ..... H04W 4/029
10,553,086 B2 * 2/2020 Lim ..... G08B 13/00
2001/0030082 A1 * 10/2001 Overby ..... A62B 1/02 182/142
2002/0155622 A1 10/2002 Slater et al.
2004/0075566 A1 * 4/2004 Stepanik ..... G08B 21/12 340/632
2004/0153671 A1 * 8/2004 Schuyler ..... G07C 9/00 726/9
2005/0173189 A1 * 8/2005 Berardi ..... E06C 7/003 182/18
2005/0233289 A1 * 10/2005 Hoglund ..... G09B 19/00 434/226
2006/0010504 A1 * 1/2006 Sharma ..... H04M 11/045 726/35
2006/0032704 A1 * 2/2006 Chandra ..... E06C 7/003 182/18
2006/0102422 A1 * 5/2006 Loayza ..... A62B 1/06 182/36
2006/0156966 A1 * 7/2006 Stilson ..... B63B 19/00 114/201 R
2006/0261941 A1 * 11/2006 Drake ..... G01F 15/063 340/539.26
2007/0036640 A1 * 2/2007 Boudreaux ..... B65D 88/54 414/800
2008/0068601 A1 * 3/2008 Thayer ..... G01B 11/24 356/241.3
2008/0155064 A1 * 6/2008 Kosuge ..... E03F 7/00 709/219
2009/0249712 A1 * 10/2009 Brickell ..... A62B 1/10 52/173.1
2011/0048853 A1 * 3/2011 Brickell ..... A62B 1/16 182/5
2011/0140913 A1 * 6/2011 Montenero ..... G08B 21/0233 340/870.07
2011/0316699 A1 * 12/2011 Arunachalam ..... G08B 29/24 340/540
2014/0333432 A1 * 11/2014 Armitage ..... G08B 25/016 340/539.11
2014/0368354 A1 12/2014 Skourlis
2015/0163652 A1 6/2015 Michaud et al.
2015/0338035 A1 * 11/2015 Jacobson ..... F21L 4/02 362/184
2016/0010445 A1 1/2016 Harrison et al.
2016/0066068 A1 3/2016 Schultz et al.
2016/0371949 A1 12/2016 Kraz et al.
2017/0314328 A1 * 11/2017 Friedman ..... E06C 7/003
2018/0112464 A1 * 4/2018 Tang ..... E06C 7/003

FOREIGN PATENT DOCUMENTS

CN 101545897 A 9/2009
CN 202707148 U 1/2013
CN 204646075 U * 9/2015
CN 105021775 A 11/2015
CN 105136997 A 12/2015
GB 1550615 8/1979
KR 20110053826 A 5/2011
WO 2016081821 A1 5/2016

OTHER PUBLICATIONS

Freeport-McMoRan Copper & Gold; FCX Department of OSHA; Confined Space Policy, 2013; 37 pages.
Alexandros Pantelopoulos and Nikolaos G. Bourbakis, Fellow, IEee; A Survey on Wearable Sensor-Based Systems for Health Monitoring and Prognosis; 2010, 12 pages.
V. Ramya, B. Palaniappan; Embedded Technology for vehicle cabin safety Monitoring and Alerting System; 2012; 12 pages.

* cited by examiner

CONFINED SPACE FAILSAFE ACCESS SYSTEM

CROSS-REFERENCE TO RELATED APPLICATIONS

This application claims benefit under 35 USC § 119(e) of provisional application No. 62/505,636 filed May 12, 2017. The '636 application is incorporated, by reference herein.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the field of occupational safety as it applies to Confined spaces. Confined space entries that are safe and United States Occupational Safety and Health Administration (OSHA) compliant require personnel to meter the atmosphere prior to entry to ensure that it poses no danger to the entrant. Other countries have similar regulatory organizations and requirements.

Many infrastructure and industrial facilities have confined spaces that must be accessed on a routine basis to support or maintain operations. Many safety regulatory agencies around the world have similar definitions to define what constitutes a confined space. In the United States, OSHA defines a confined space as, (Excerpted from OSHA 3138-01R 2004):

Many workplaces contain spaces that are considered to be "confined" because their configurations hinder the activities of employees who must enter into, work in or exit from them. In many instances, employees who work in confined spaces also face increased risk of exposure to serious physical injury from hazards such as entrapment, engulfment and hazardous atmospheric conditions. Confinement itself may pose entrapment hazards and work in confined spaces may keep employees closer to hazards such as machinery components than they would be otherwise. For example, confinement limited access and restricted airflow can result in hazardous conditions that would not normally arise in an open workplace.

The terms "permit-required confined space" and "permit space" refer to spaces that meet OSHA's definition of a "confined space" and contain health or safety hazards. For this reason, OSHA requires workers to have a permit to enter these spaces.

By definition, a confined space:

Is large enough for an employee to enter fully and perform assigned work;

Is not designed for continuous occupancy by the employee; and

Has a limited or restricted means of entry or exit. These spaces may include underground vaults, tanks, storage bins, pits and diked areas, vessels, silos and other similar areas.

By definition, a permit-required confined space has one or more of these characteristics:

Contains or has the potential to contain a hazardous atmosphere;

Contains a material with the potential to engulf someone who enters the space;

Has an internal configuration that might cause an entrant to be trapped or asphyxiated by inwardly converging walls or by a 3 floor that slopes downward and tapers to a smaller cross section; and/or Contains any other recognized serious safety or health hazards Confined spaces are inherently dangerous to workers. Many industrial accidents in confined spaces result in death and injury of exposure to other hazards that may not be obvious prior to entry. Accidents in confined spaces have led to secondary deaths or injuries to workers who try and rush to the aid of a fellow worker and fall victim to a hidden hazard. It is estimated that up to 100 work-related deaths in the United States occur on an annual basis from accidents related to operations conducted within these dangerous environments.

As a result of the dangers associated with confined space entry, OSHA and other regulatory agencies have mandated that certain procedures be followed when an individual must enter these locations. These procedures are intended to reduce the risk of injury to an individual that must enter the space.

Atmospheric testing of confined spaces prior to entry are critical to safe entry of many confined spaces. One of the primary sources of death and injury to workers involved in confined space entry operations is asphyxiation. Proper safety protocols have been defined by OSHA that mandates that the atmosphere is tested with certified equipment and for a sufficient length of time by an individual who is appropriately trained on its operation.

Excerpts from an OSHA fact sheet, (Title 29 Code of Federal Regulations 1910.146, Appendix B. 2 29 CFR 1910.146(c)(5)(ii)(C) and (d)(5)(iii)), on gas metering in advance of confined space entry is as follows:

Atmospheric testing is required for two distinct purposes: evaluation of the hazards of the permit space and verification that acceptable conditions exist for entry into that space.

Evaluation Testing:

The atmosphere within a confined space must be tested using equipment that is designed to detect the chemicals that may be present at levels that are well below the defined exposure limits.

Evaluation testing is done to:

determine what chemical hazards are or may become present in the space's atmosphere, and identify what steps must be followed and what conditions must be met to ensure that atmospheric conditions are sale for a worker to enter the space.

Verification Testing:

Before a permit space that may have a hazardous atmosphere can be entered, the atmosphere must be tested using the steps identified on the permit (developed during evaluation testing). Verification testing is done to make sure that the chemical hazards that may be present are below the levels necessary for safe entry, and that they meet the conditions identified on the permit. Test the atmosphere in the following order:

(1) for oxygen, (2) for combustible gases, and then (3) for toxic gases and vapors.

Problem Defined:

Atmospheric testing in a confined space is usually conducted using a multi-gas meter that is specifically designed to test for such atmospheric conditions as Oxygen levels, Hydrogen Sulfide levels, Carbon Monoxide levels and LEL, (lower explosive levels of combustible gases). This suitable regulatory agency compliant device will be referred to in this document as an atmospheric sensor/meter.

In some instances, injuries and fatalities will occur when individuals enter into a confined space without the appropriate training or access to appropriate safety equipment and do not take proper measures of metering the atmosphere prior to entry. In these situations, it is easy to understand how an unnecessary death or injury could result.

Unfortunately, there are also confined space accidents that occur with individuals who have been trained and have access to vital safety and monitoring equipment. In the majority of these cases, it is the entrant who will accidently or willfully neglect to properly test the atmosphere of the confined space prior to entry. As a result of these careless and dangerous acts by those individuals and despite confined space entry training; knowledge of regulatory safety agency regulations; knowledge of company safety policy mandating atmospheric testing prior to entry and access to appropriate atmospheric metering technology fatalities and injuries still occur in the workplace due to asphyxiation in confined spaces.

When a worker neglects to meter the atmosphere, he is taking unnecessary chances with his health and well-being and increases the potential liability of his employers. An employee who engages in this breach of safety protocol may often repeat his advance atmospheric testing omission many times with increasing confidence, until it is too late and there is an accident. In most instances, the atmosphere will be sufficiently safe for human life and the employee will suffer no permanent ill consequences. His risky behavior may go unnoticed by supervisory staff until he enters a confined space that has an atmosphere that will not support human life and there is a death or serious injury.

BRIEF SUMMARY OF THE INVENTION

A method of preventing access to a dangerous confined space atmospheric environment is herein described. The unique safety feature of this invention is that it forces a safety reading of a confined space atmosphere and will issue a preemptive alarm in advance of entry. This is accomplished by marrying the atmospheric meter-alarm system to the mechanism that is utilized to facilitate ingress and egress to and from the confined space. This alarm would remove significant if not all doubt of the user that physical entrance to the confirmed space is life threatening from a dangerous atmosphere in advance of entry. Further the testing and alarm will indicate to surrounding personnel and facilities management, that critical safety procedures are not being followed, acting as a deterrent to the operator/entrant to not maintaining established safety producers. This protection is accomplished as a natural consequence of facilitating the entrant access to the space.

BRIEF DESCRIPTION OF THE DRAWINGS

The present invention can best be understood in connection with the accompanying drawings. It is noted that the invention is not limited to the precise embodiments shown in the drawings in which the drawing Figures are described as follows.

DETAILED DESCRIPTION OF THE INVENTION

Figure 1:
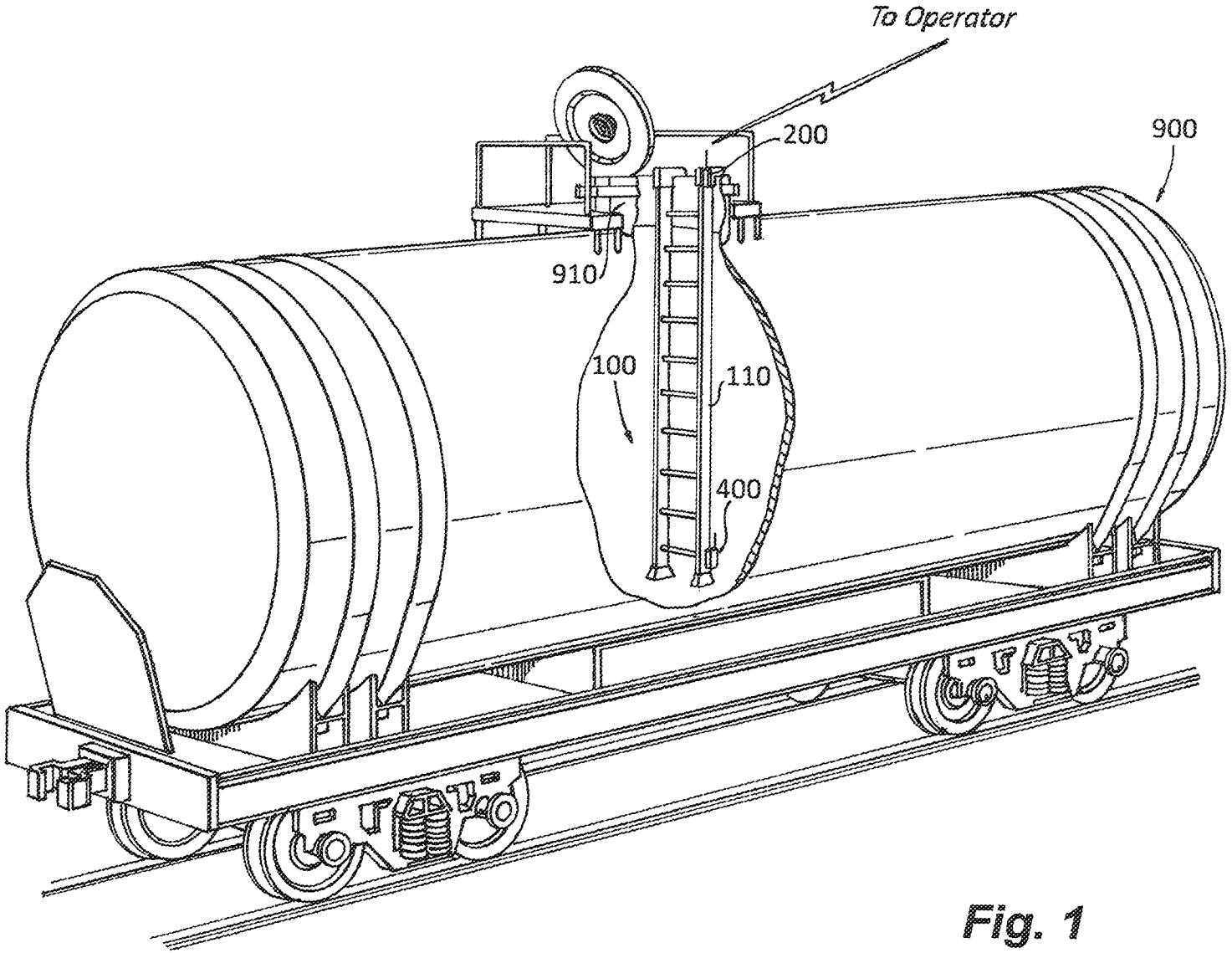
FIG. 1 is an overall perspective view in partial cutaway, of the basic invention installed into a typical confined space with atmospheric sensor and Alarm Status Annunciator Module (ASAM) shown mounted to the entrance assembly, in this example, a ladder.

FIG. 1 shows a confined space 900, with an entrance port 910 into which an entrance assembly 100 has been inserted. The confined space 900 here is depicted here as a mobile tank, but could be any number of different confined spaces including fixed or mobile tanks, vaults, utility spaces, or any confined space meeting the definition previously described. The entrance assembly 100 comprises a means to physically enter and exit the confined space 900, in this case shown as a ladder 110, one or more gas sensor or meters 400, and an alarm status annunciator module, (ASAM) 200. A suitable regulatory agency compliant gas sensor or meter 400 tests the atmosphere within the confined space 900 before the human operator can enter the confined space. The status of the gas sensor or meter 400 is communicated electronically by wire or a wireless means to the alarm status annunciator module, (ASAM) 200, which in turn communicates to the operator and other parties whether the environment is safe or unsafe or indeterminate for entry, by means a visual indication and audible single. As an example, a safe condition may be indicated with a steady green light 210G, unsafe with a red strobe 210R and audible siren 220, and indeterminate with a yellow light 210Y and intermittent audible sound 220. Voice annunciation can be added to specify a specific threat condition, urgency, etc. Specific indicators can be customized for specific safety conventions, operating conditions, etc.

Figure 2:
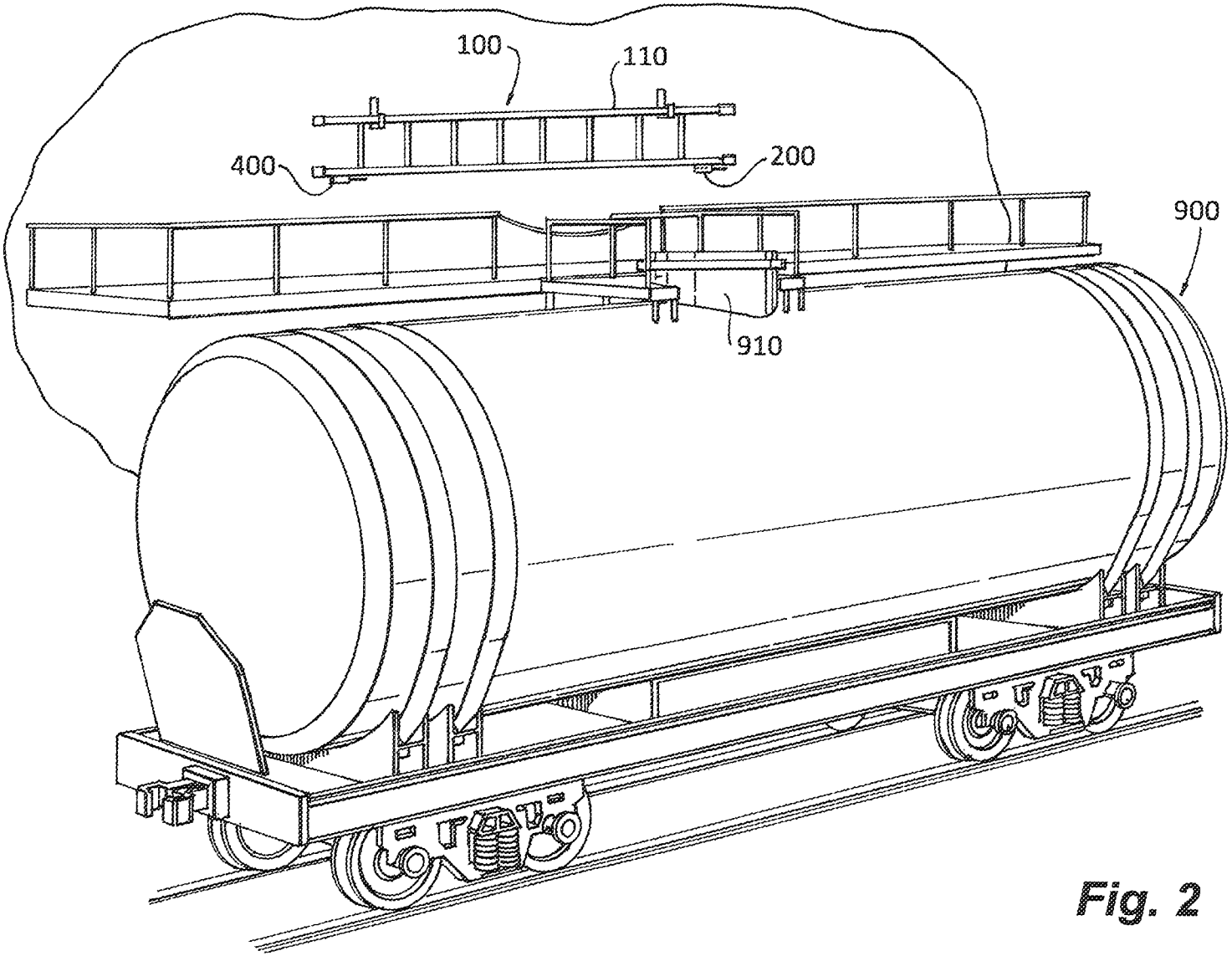
FIG. 2 is a perspective view depicting the entrance assembly in its dormant storage orientation in the general vicinity of the confined space entrance.

FIG. 2 shows the entrance assembly 100 in a stored or dormant mode in convenient proximity to a typical confined space entrance 910.

Figure 3:
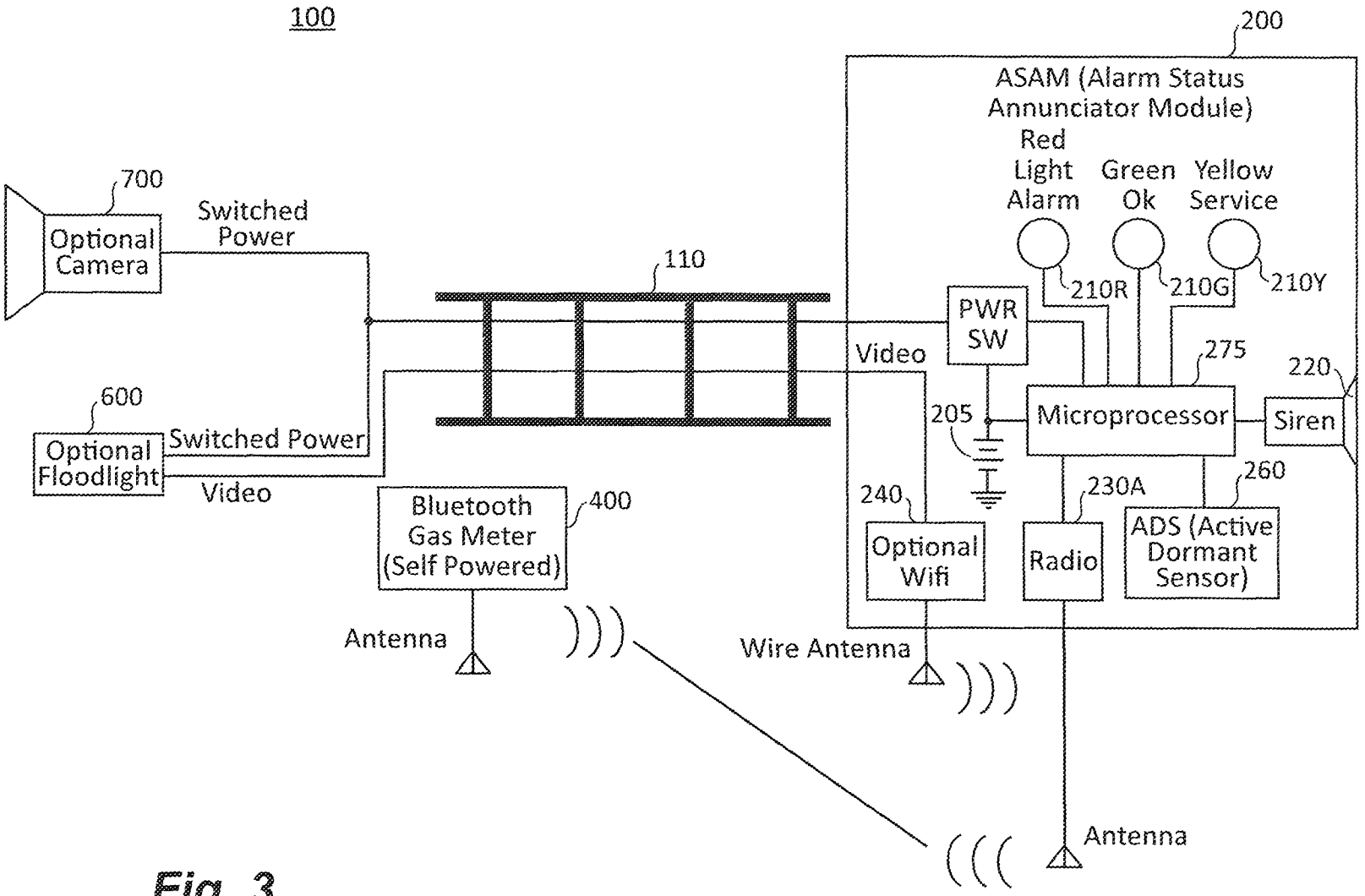
FIG. 3 is a block diagram of the system configured with the Alarm Status Annunciator Module (ASAM) and the gas sensor/meter mounted directly to the entrance assembly with a wireless motor interface, wherein optional accessories are also shown.
Figure 3A:
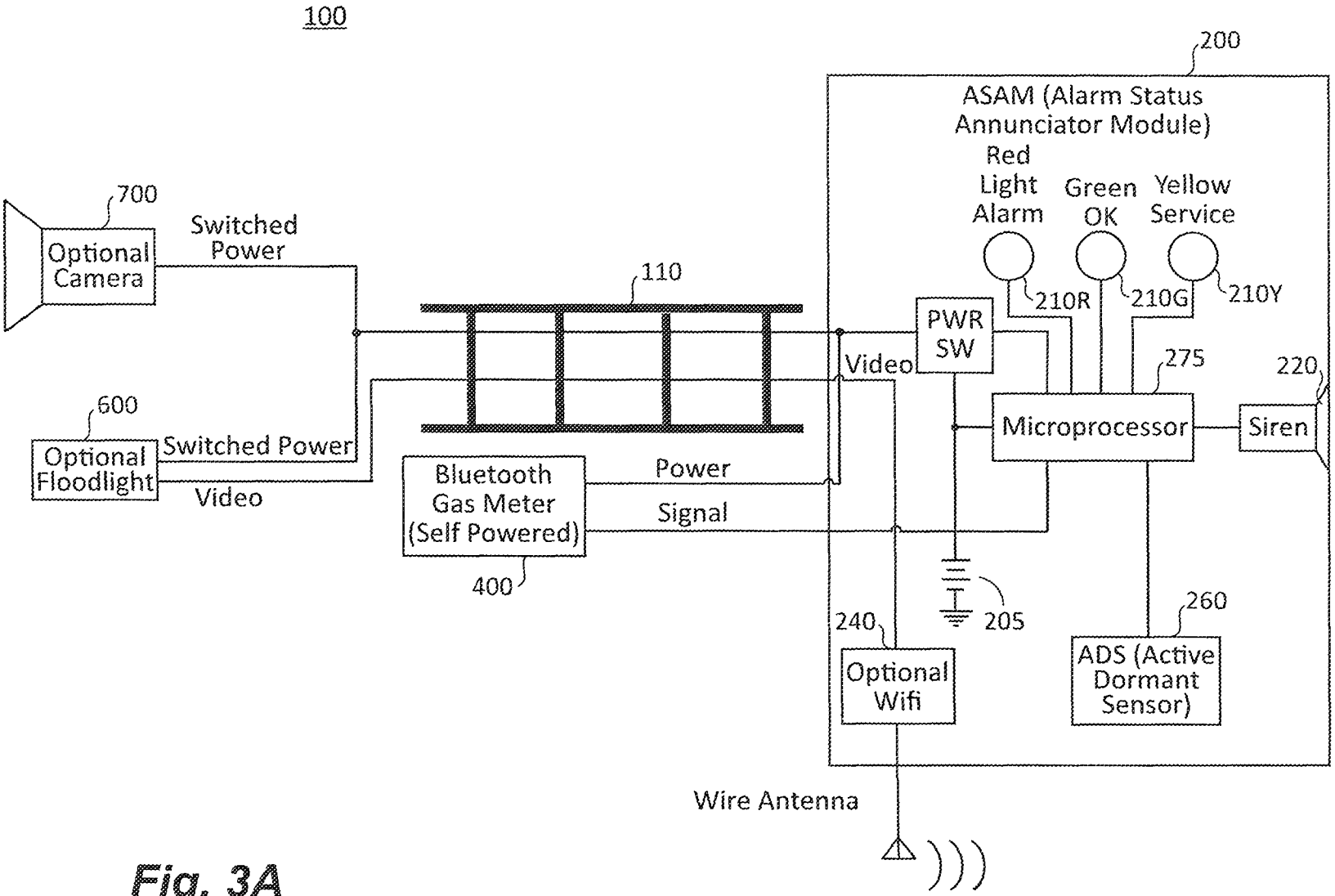
FIG. 3A is a block diagram of the system configured with the Alarm System Annunciator Module (ASAM) and the gas sensor/meter mounted directly to the entrance assembly, with a wired meter interface, wherein optional accessories are also shown.

FIGS. 3 and 3A depict typical system block diagrams of the overall entrance assembly 100 including a number of optional components. In its simplest form the entrance assembly 100 comprises the ladder 110 or other device that facilitates physical entry into the confined space 900, with a gas sensor or meter 400 and alarm status annunciator module, (ASAM) 200 attached. In its simplest form the gas sensor or meter 400 and alarm status annunciator module, (ASAM) 200 are wired together communicate with each other as shown in FIG. 3A. The alarm status annunciator module, (ASAM) 200 could be used to directly power the gas sensor or meter 400 and control its on/off state, thus simplifying power management for both devices.

Options include a work light 600, video camera sensor 700 to remotely monitor the working in the confined space 900, and various wireless telemetry for communicating to sensors and communicating to remote monitoring locations by WiFi, Bluetooth, ZigBee or other similar wireless communication protocols.

Depending on the physical geometry of the confined space 900 and the appropriate entrance device 110 it may be more practical to use a self-powered gas sensor or meter 400 with a wireless connection to the alarm status annunciator module, (ASAM) 200 for more flexibility as shown in FIG. 3. This connection could be any of the wireless options previously described. Further breakdown and description of the alarm status annunciator module, (ASAM) 200 are described below. The alarm status annunciator module, (ASAM) 200 can act as a wireless repeater to negate the effect of a metal confined space 900 enclosure, such as a steel tank, that may restrict or attenuate its output signal level of the transmitter that is inserted into this space. This wireless repeater will allow wireless data transmitted from a wireless data source, using a wireless protocol, such as, but not limited to, Bluetooth or Wi-Fi, to devices outside of the space in a reliable fashion.

Figure 4:
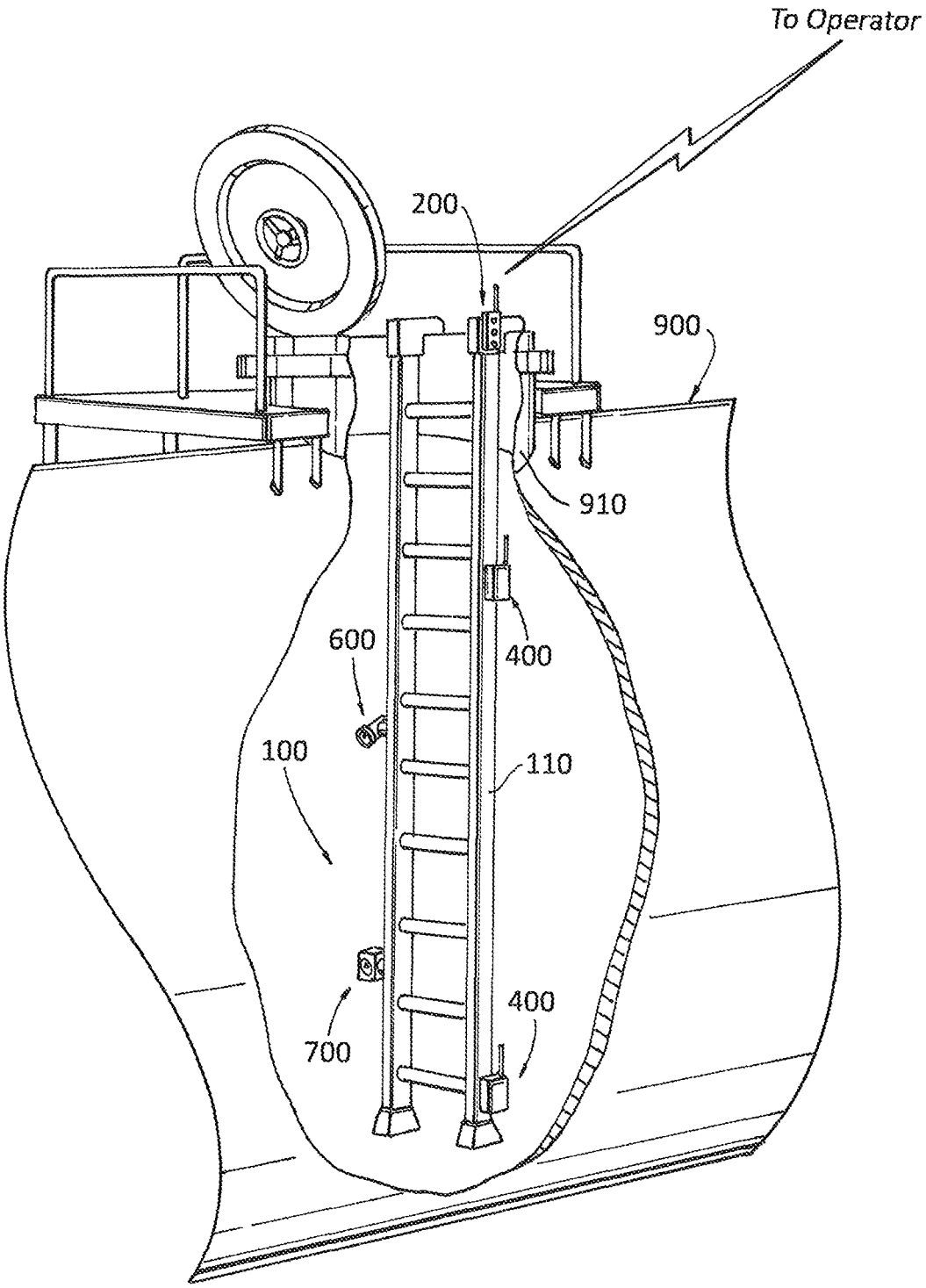
FIG. 4 is an overall perspective view in partial cutaway of an enhanced version of invention installed into a typical confined space with multiple atmospheric sensors and Alarm Status Annunciator Module (ASAM), Video camera and integrated work light shown mounted to is the entrance assembly, in this example, a ladder.

FIG. 4 shows a version of the entrance assembly 100 with multiple gas sensor or meters 400, optional video sensor 600 and integrated work light 700. The work light 600 and the video camera sensor 700 can optionally be combined into a single enclosure.

Figure 5:
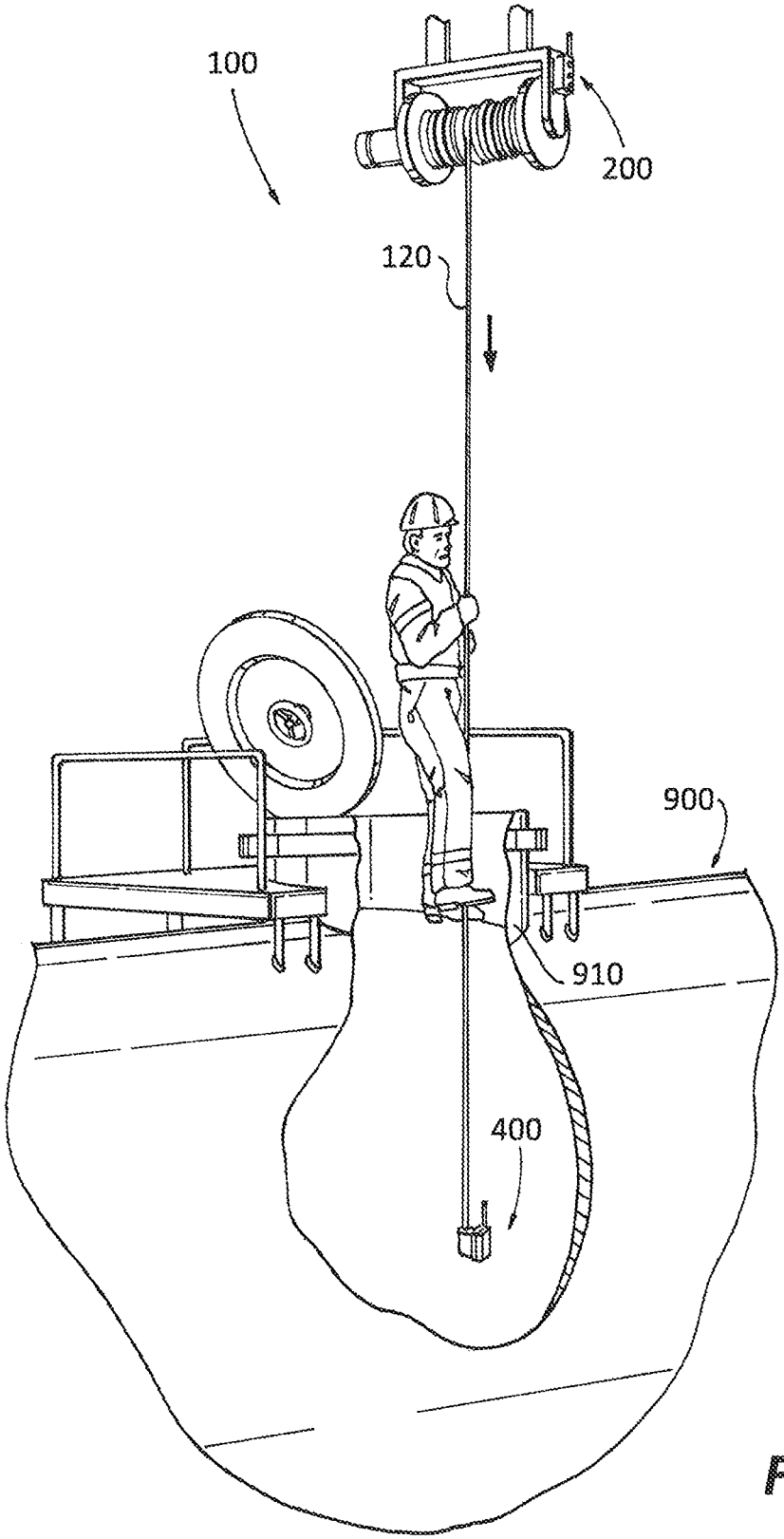
FIG. 5 is an overall perspective view in partial cutaway of another example of an entrance device, in this example, a cable system, with an atmospheric sensor and Alarm Status Annunciator Module (ASAM) shown mounted.

FIG. 5 shows an alternate entrance assembly 100, in this case built around a cable based entrance assembly 120. This also shows how a wireless connection between the gas sensor or meter 400 and the alarm status annunciator module, (ASAM) 200 might be more practical. As with the ladder based entrance assembly, the cable based entrance assembly must be configured such that the sampling point of the gas sensor or meter 400 enters and reports the atmospheric condition of the confined space before the entrant reaches a potentially unsafe position within the confined space.

Figure 6:
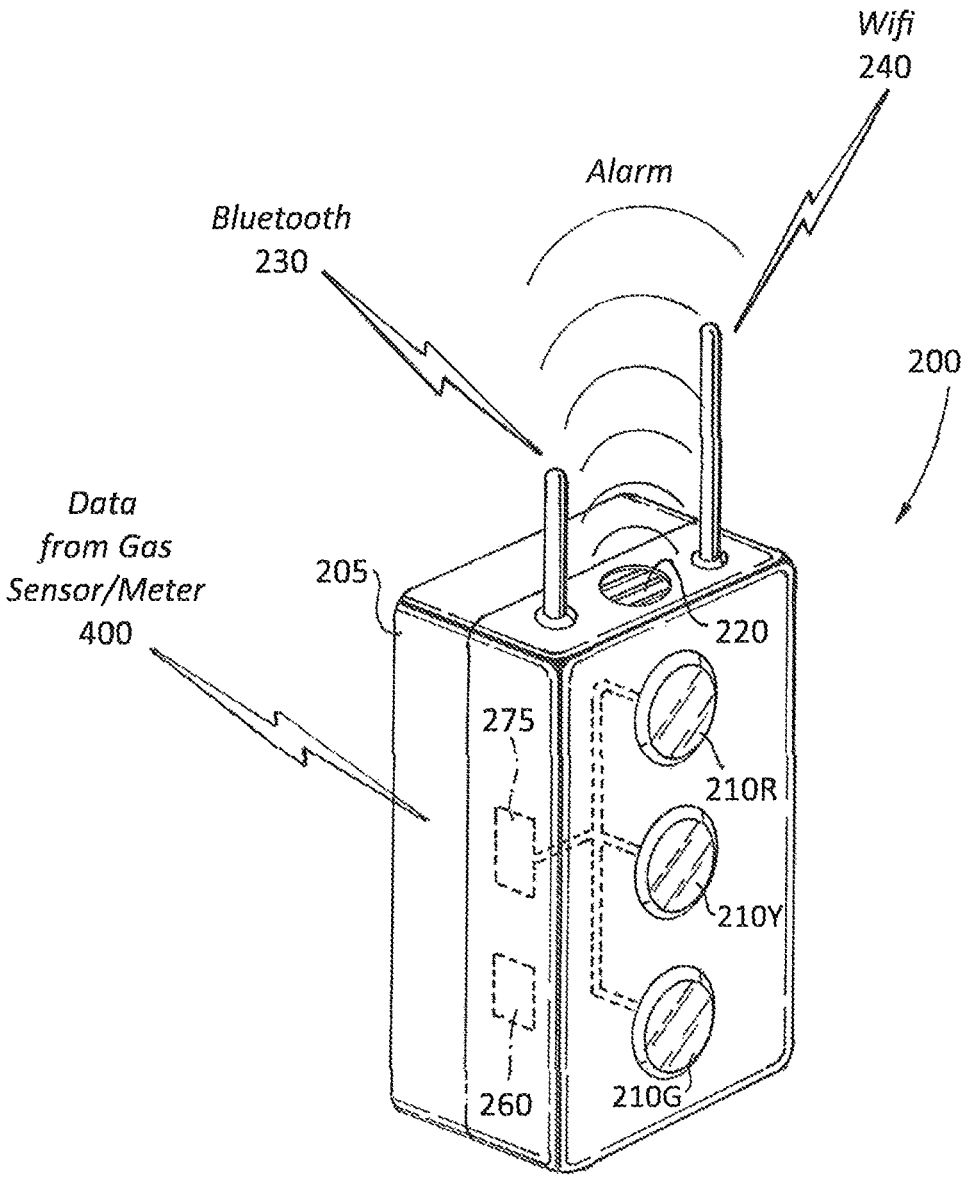
FIG. 6 is a close-up detail view showing the Alarm Status Annunciator Module (ASAM).

FIG. 6 along with the alarm status annunciator module, (ASAI) 200 portion of the block diagram in FIG. 3 describes the alarm status annunciator module, (ASAM) 200. The alarm status annunciator module, (ASAM) 200 comprises a power source 205 which can be a rechargeable battery and or a field replaceable long life battery. Optionally, the rechargeable battery can be configured to charge when the entrance assembly 100 is stored in it dormant position when not in use. Included in the basic version is a microprocessor for receiving sensor data including from the active/dormant sensor 260 and the gas sensor/meter 400 and initiating status indications and alarms as appropriate to visual alarms or indicators 210R, 210G, 210Y, an audible alarm 220, and optionally, the alarm status annunciator module, (ASAM) 200 can incorporate wireless communications such as WiFi 240 and/or Bluetooth 230 to communicate with sensors and network.

Figure 7:
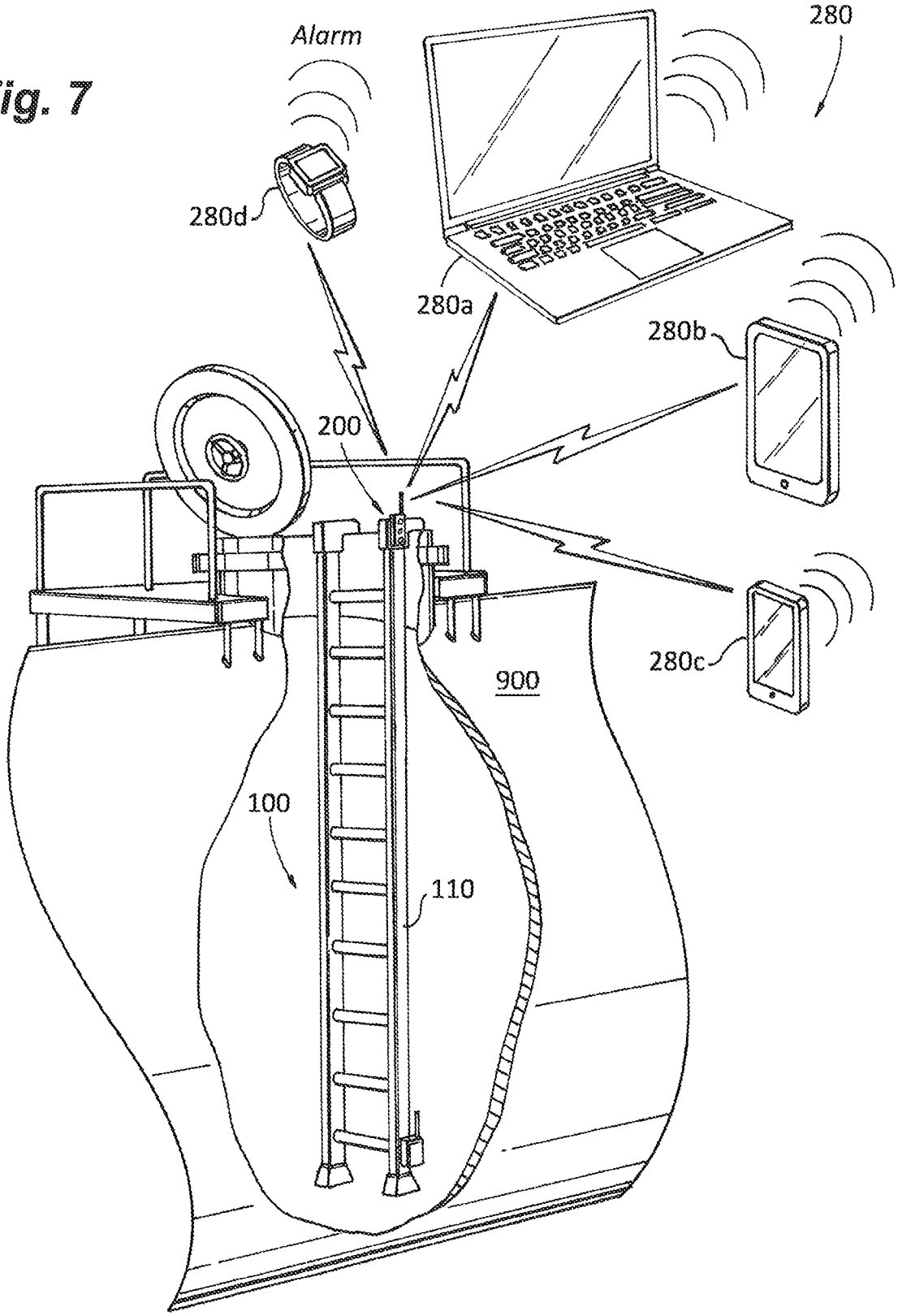
FIG. 7 is a diagrammatic view showing the remote, networked communication device receiving an alarm from the confined space access system.

FIG. 7 depicts a monitoring station computer 280 which receives telemetry from the entrance assembly alarm status annunciator module, (ASAM) 200. This telemetry would typically be through a wireless access point and/or wired network connection. This monitoring station would be utilized to provide alerts to a monitoring person outside of the confined space area. The monitoring station computer 280 would run software that receives and interprets the telemetry from the confined space entry system to log data and provide alerts from each of multiple confined space entry systems 100 on the network. The monitoring station 280 can be provided in the form of a PC console 280*a*, tablet 280*b* or mobile device (such as a smartphone 280*c* or wearable mobile device 280*d*, i.e., a smart watch)

Figure 8:
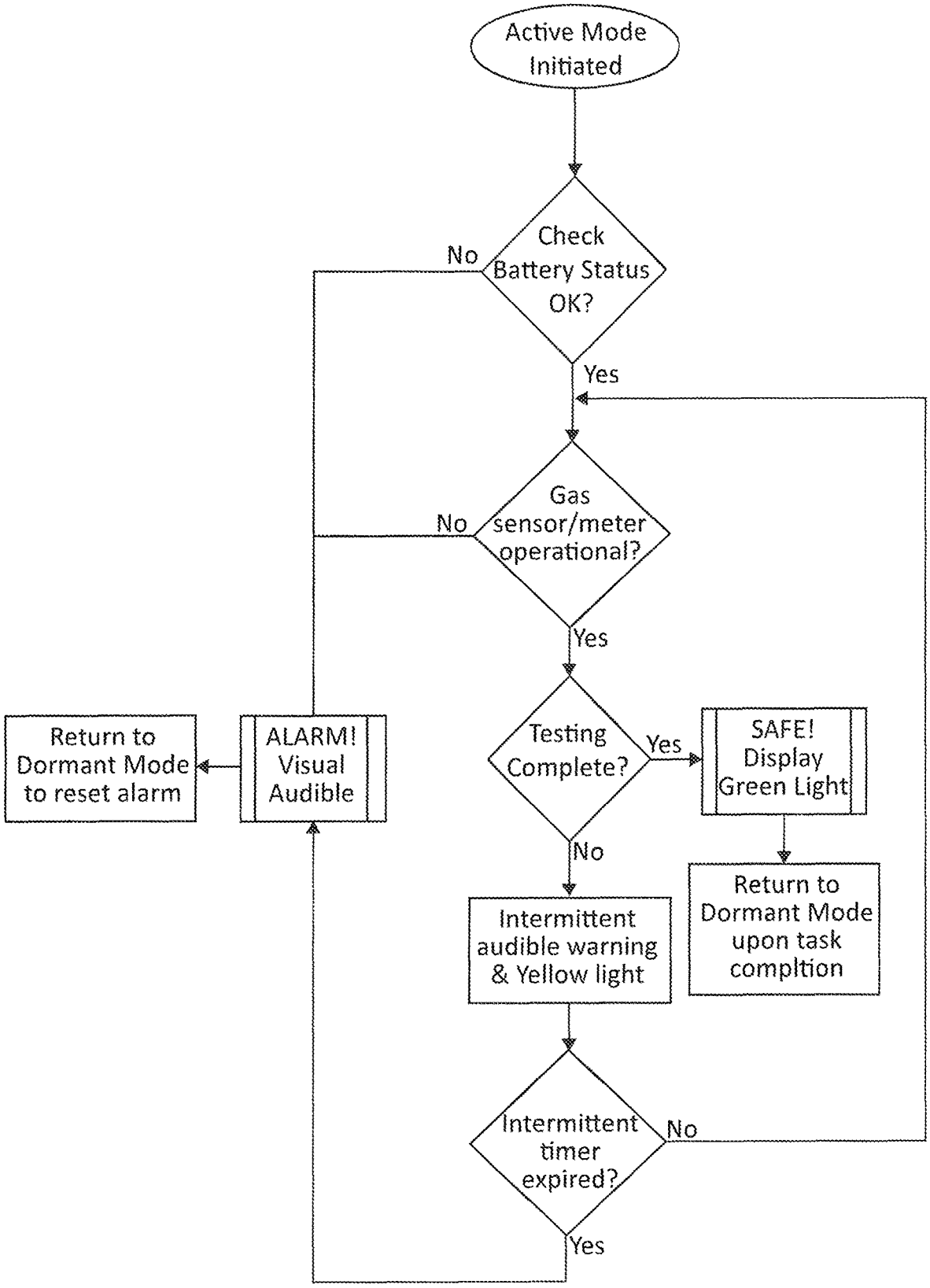
FIG. 8 is a flow chart showing a basic logic diagram for programming the Alarm Status Annunciator Module (ASAM) microprocessor or the Active/Dormant Sensor Module (ADM).

FIG. 8 shows a basic logic diagram for the program running on the alarm status annunciator module, (ASAM) 200 microprocessor 270. Many other functions that enhance the functionality of the overall system can also be included here.

Figure 9:
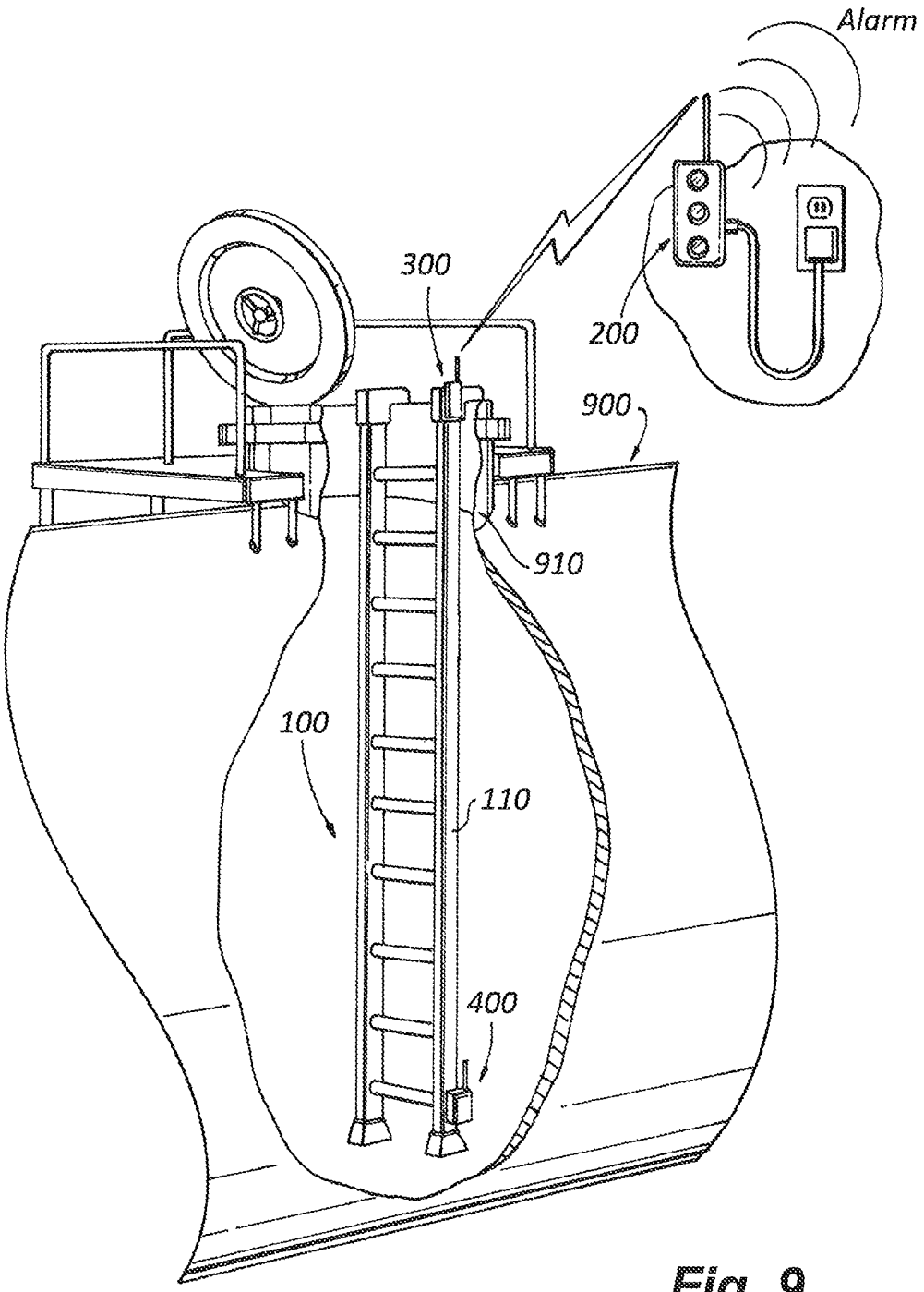
FIG. 9 is a perspective view in partial cutaway showing an alternate configuration of the invention installed into a typical confined space, where the Status Annunciator Module (ASAM) is mounted separately from the entrance assembly; in this case a ladder, and multiple atmospheric sensors and active/dormant module (ADM) are mounted to the entrance assembly.

FIG. 9 shows an alternate embodiment of the system, where the alarm status annunciator module, (ASAM) 200 is located in a fixed position in proximity to the confined space entrance port 910 and an active/dormant Module (ADM) 300 is secured to the entrance assembly 100 instead. In this case the active/dormant sensor 260 is moved from the alarm status annunciator module, (ASAM) 200 in the previous description to the active/dormant Module (ADM) 300. This embodiment allows the alarm status annunciator module, (ASAM) 200 to be large, with more robust enunciators, wired into mains power, and optionally connected to a wired network while more clearly able to broadcast alarms and status to the surrounding area than as necessitated by smaller, battery powered alarm status annunciator module, (ASAM) 200 located directly onto the entrance assembly 100 as in the prior described embodiment. The active/dormant Module (ADM) 300 can be kept small with low power consumption required and is used primarily to wirelessly transmit the active/dormant sensor 260 information to the remotely located active/dormant sensor 260. Optionally the active/dormant Module (ADM) 300 can be configured to transmit status from the gas sensor/meter 400 to the remote alarm status annunciator module, (ASAM) 200. Since the alarm status annunciator module, (ASAM) 200 and the active/dormant Module (ADM) 300 contain a microprocessor and wireless communications, the sensor telemetry and warning logic tasks can be split between the two modules in many ways to maximize efficiency and fail safe operation of the overall system.

Figure 10:
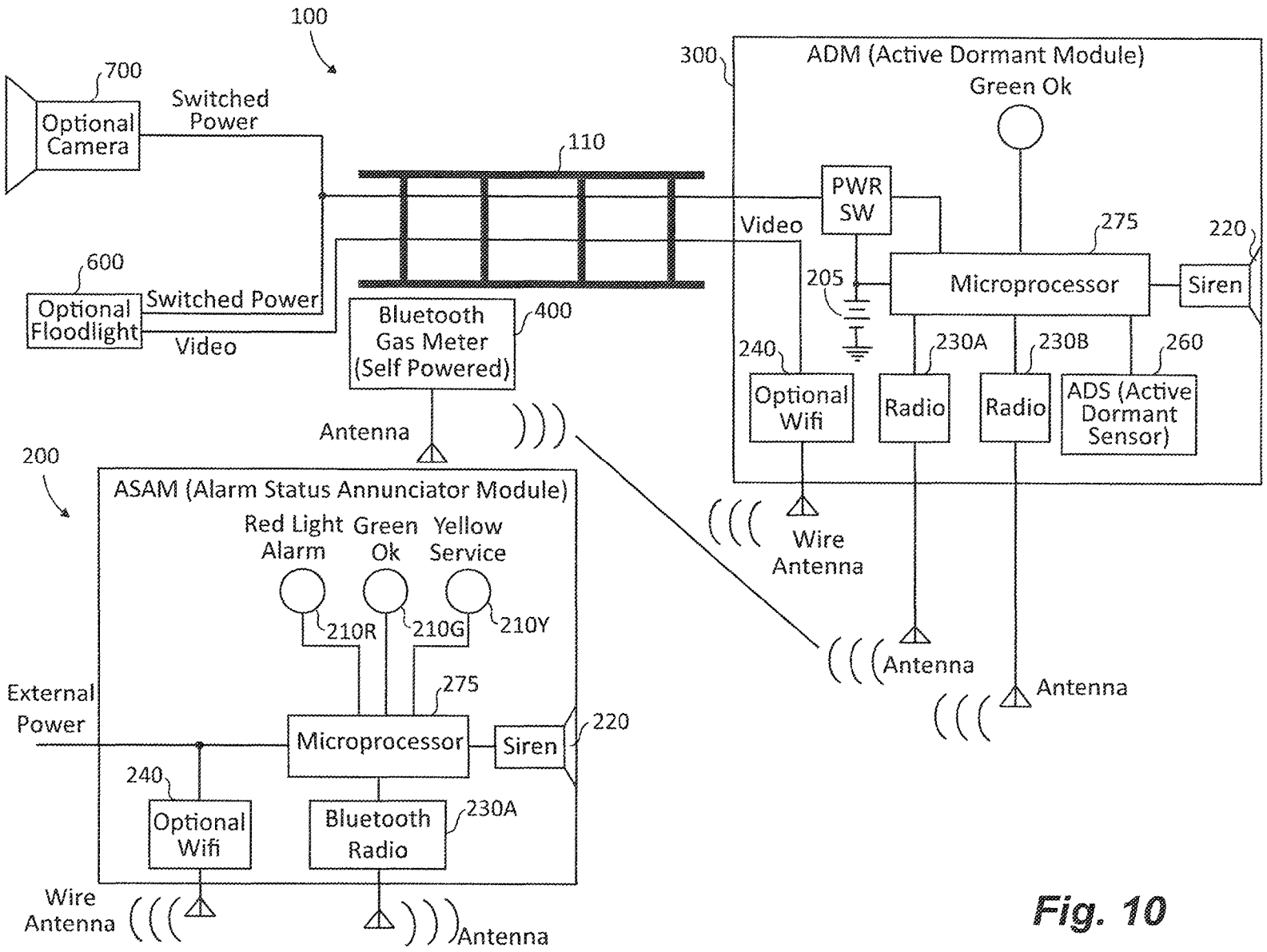
FIG. 10 is a block diagram of the system showing a typical system utilizing the Active/Dormant Sensor Module (ADM) to relay the data to a remote Alarm Status Annunciator Module (ASAM).

FIG. 10 is a block diagram of the alternate embodiment of the system. Here, the active/dormant Module (ADM) 300 is part of the physical entrance assembly 100, and the alarm status annunciator module, (ASAM) 200 is located physically separate from the entrance assembly 100 at a nearby fixed location.

The details of features in the overall system are otherwise the same as described in FIG. 3.

Options shown include a work light 600, video camera sensor 700 to remotely monitor the working in the confined space 900, and various wireless telemetry for communicating to sensors and communicating to remote monitoring locations by WiFi, Bluetooth, ZigBee or other similar wireless communication protocols.

Figure 11:
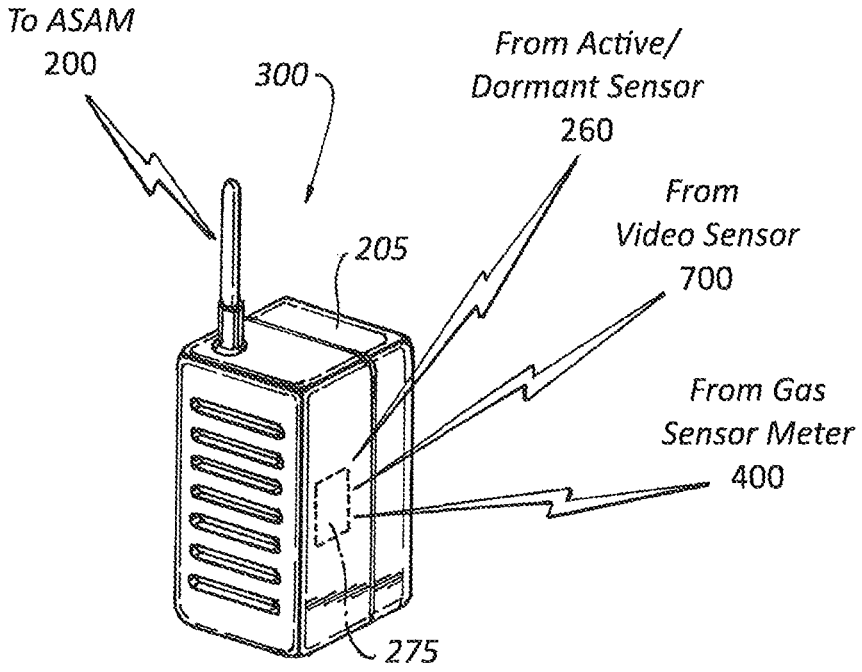
FIG. 11 is a close-up detail view showing the Active/Dormant Sensor Module (ADM).

FIG. 11 along with the active/dormant Module (ADM) 300 portion of the block diagram in FIG. 10 describes the active/dormant Module (ADM) 300. The active/dormant Module (ADM) 300 contains a power source 205 which can be a rechargeable battery and or a field replaceable long life battery. Optionally, the rechargeable battery can be configured to charge when the entrance assembly 100 is stored in its dormant position when not in use. Included in the basic version is a microprocessor for receiving sensor data including from the active/dormant sensor 260, optional video sensor 700 and the gas sensor/meter 400 and wirelessly transmitting the status of each to the alarm status annunciator module, (ASAM) 200. Optionally, a wireless version of the gas sensor/meter 400 could also transmit its status directly to the alarm status annunciator module, (ASAM) 200 assuming its wireless capability can reliably communicate with the alarm status annunciator module, (ASAM) 200 when the entrance assembly 100 is installed in its active position. This option would depend on the details of the physical geometry of the overall system and the capabilities of the wireless components.

Figure 12:
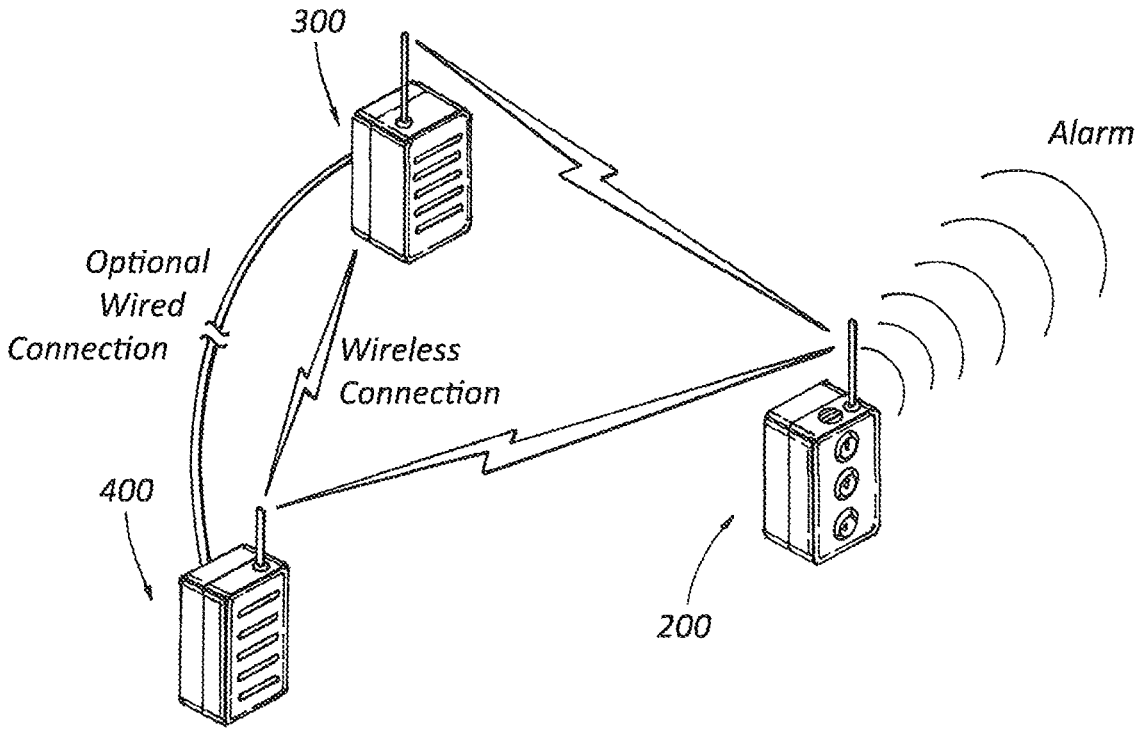
FIG. 12 is a diagrammatic view showing the possible data path between the alarm status annunciator module, (ASAM), the active/dormant Module (ADM), and the gas sensor/meter.

FIG. 12 shows the possible wired and wireless data paths between the alarm status annunciator module, (ASAM) 200, the active/dormant Module (ADM) 300, and the gas sensor/meter 400.

Note that the gas sensor/meter 400 can connect wirelessly (if so capable) directly to the alarm status annunciator module, (ASAM) 200, or to the active/dormant Module (ADM) 300 depending on what makes most sense giving the wireless capability of the gas sensor/meter 400 and the physical geometry of the confined space and surrounding area. The gas sensor/meter 400 can also be wired to the active/dormant Module (ADM) 300.

This method and invention is designed to prevent access into a confined space 900 that has an atmosphere that is not suitable to sustain life by generating a conspicuous alarm response when entry is initiated. It is accomplished by affixing a suitable regulatory agency compliant gas sensor or meter 400 to one end of a mechanical assembly 100 that facilitates access into and egress out of the confined space 900 by the entrant. The preferred gas sensor/meter 400 can be one of two basic types depending on the specific application and expected potential hazards. One type is self-contained and samples the atmosphere in its immediate vicinity. The other can incorporate a sampling tube to enable it to sample the atmosphere at some distance from the meter. This type of device can also effectively sample from multiple locations either by incorporating a manifold with multiple sampling tubes with multiple sampling locations, or a single sampling tube with multiple ports. This would allow sampling at more than one depth in the confined space with a single meter to take into account atmospheric stratification that could exist at different levels of the confined space due to variations in gas density. Either gas meter type requires the ability to communicate wirelessly or by wire a meter status condition including an alarm state to the system. Preferably the gas sensor or meter can also communicate its own health status including functionality of its sensors and battery charge status. The location of where the atmospheric sample is taken need not necessarily be where the meter is physically located by using a meter incorporating a sampling tube. In this case the sample is taken from the sampling point at the end of the sampling tube or from multiple sampling tubes or multiple sampling points along the length of the sampling tube. These gas meters as described are readily available in the marketplace from multiple vendors and, can be selected as required for specific features, ease of mounting and compatibility with communication with the other modules of the system.

Examples of the entrance assembly 100 include but are not limited to a cable 120, ladder 110, ramp, stairway or any other assembly or device that will facilitate physical entry in to the confined space 900. For the purpose of simplifying the system description, we refer to this mechanical assembly that facilitates access and egress as the entrance assembly 100.

The sampling point of the atmospheric sensor/meter 400 is immersed into the confined space 900 environment in advance of the entrant as a natural consequence of utilizing the entrance assembly 100. When the entrance assembly 100 is put into position, the atmospheric sensor/meter 400 sampling point will monitor the atmosphere and communicate its status using wired or wireless means to an alarm status annunciator module, (ASAM) 200, or the active/dormant Module (ADM) 300 depending on the system configuration chosen. The remote annunciators of the alarm status annunciator module, (ASAM) 200 can consist of audible alarms 220, visual alarms 210 and network, data telemetry 230, 240 for remote alerts and archival storage that an alarm event occurred though a networked computer 280.

The alarm status annunciator module, (ASAM) 200, can be mounted on the opposite end of the entrance assembly 100 or mounted/positioned in close proximity to the confined space entrance 205. In either instance, the ASAM 200 resides outside of the confined space. The ASAM 200 can indicate an alarm condition with, but not limited to, red strobe lights 210R and a high decibel audio alarm 220. Conversely, the alarm status annunciator module, (ASAM) 200 can indicate that an acceptable atmosphere exists in the space with a green light 210G, or some other type of annunciator signal. The alarm condition will be generated after the ladder is inserted into the access port 910 into the confined space 900. (i.e. hatch or manway), but before the entrant has an opportunity to enter into the space. The alarm status annunciator module, (ASAM) 200 can also record the atmospheric readings from the gas sensor/meter 400 along with a time and date stamp in a digital memory log. The alarm status annunciator module, (ASAM) 200 can also interface with a local area network to communicate overall status and alarm conditions to other individuals and locations though a networked computer 280.

The active/dormant sensor 260 function can be either incorporated into the alarm status annunciator module, (ASAM) 200 or into a remote active/dormant Module (ADM) 300 that communicates with the alarm status annunciator module ASAM 200. The entrance assembly 100 is monitored by the active/dormant sensor 260 that can indicate an operational mode or a dormant mode. This sensor need not be inserted into the confined space. An operational mode would be when the entrance assembly 100 is put into a position where it would be used to gain access into a confined space 900. This same sensor can also monitor when an individual mounts the ladder. This would indicate that the gas sensor/meter 400 should be operational and atmospheric data is representative of conditions in the confined space 900. A dormant mode would be when it is stored or otherwise not currently in use. An example of an active dormant sensor 260 could be a device that would indicate that the entrance assembly 100 is in close proximity to the tank, manway or other physical structure of the confined space 900. There are many sensor technologies that could be adapted for this purpose including, but not limited to, optical, ultrasonic, pressure, load, conduction, Hall Effect, piezo electric, and others. A simple switch could be used to change state when the entrance assembly 100 is put into an operational position and it comes into contact with the entrance way or other mechanical feature of the confined space 900. Another example could be a simple mercury switch or inclinometer that could indicate horizontal or vertical position of the ladder or other entrance assembly 100. The concept in this case being that the entrance assembly 100 would be inserted into the confined space entrance port 910 in a vertical position when operational and in a horizontal position when it is not being utilized and in its dormant mode. The alarm status annunciator module, (ASAM) 200 uses this sensor information 260 to know when to expect relevant data from an atmospheric meter/sensor and thus know when to generate an alarm. The physical location of this sensor can be located within the alarm status annunciator module ASAM 200, or the remote active/dormant Module (ADM) 300.

The operational/dormant sensor (ADS) 260 signal could be sourced from an independent system than the atmospheric sensor/meter 400 and thus could provide other status or alarm information. For example, if the operational/dormant sensor (ADS) 260 indicated an operational orientation and there was no atmospheric sensor/meter 400 data available within a timeout period, the alarm status annunciator module ASAM 200 would indicate an alarm condition to indicate that the system is not functionally operational. The alarm status annunciator module ASAM 200, could also monitor the battery condition of both the gas sensor/meter 400 and the operational/dormant sensor (ADS) 260 to generate low battery alarms. In some embodiments of the design the active/dormant sensor 260 could signal control of power to other modules in the system when it detects a dormant state, with the intention of reducing power to modules to conserve battery life when not in use. The alarm status annunciator module ASAM 200 could also monitor its own battery level as well as the battery condition of both the atmospheric sensor/meter 400 and the active/dormant sensor 260 to generate low battery alarms.

This active/dormant sensor 260 assembly can be integrated into the alarm status annunciator module, (ASAM) 200, or it can be configured as a separate active/dormant module (ADM) 300 that has its own power source and transmits its status to the remotely located alarm status annunciator module (ASAM) 200 using a wireless data transmission such as Bluetooth 230, ZigBee 230, Wi-Fi 240 or other standard or proprietary wireless data transmission protocol.

In general, the system is designed to be exceedingly difficult to defeat by the operator without causing permanent and obvious damage to the system so as to deter operators from temporarily cheating the system against their and their employer's best interests. In all situations, the alarm status annunciator module, (ASAM) 200, will indicate whether the system is functioning with an indication for Alarm 210R, Safe 210G and Indeterminate 210Y visual indicators. Tamper resistant designs will be utilized for any sensitive or programmable portions of the electro-mechanical assembly including such mechanisms as metal enclosed wire runs, anti-tamper assembly hardware, as well as safeguards against other obvious methods that might be utilized with the intention of circumventing the intention of the invention device.

Many confined spaces 900 require an individual to enter through a hatch or manway 910 and descend down into the space using a portable ladder 110. Examples of this process can be seen when examining bulk transportation operations that utilize rail tankers, hopper cars, ISO tanks or tank truck carriers. Many other confined spaces 900 can utilize this invention and method and use of these examples should in no way be considered a limitation to the use of the invention.

When it is necessary for an individual to enter into the tank for an inspection or a maintenance operation, they must open a hatch, test the atmosphere, insert a ladder, or other type of assembly that helps facilitate access into and egress out of the space and climb down into the tank area which is a confined space. This could include, but not be limited to, a ladder placed into a large vessel, tank or vault and mounted on the lip or flange of a manway, or hatch that opens into the vessel, tank or vault. In many instances, this is the only way that an individual can physically enter or exit the space. It is assumed that the atmosphere of the tank is monitored prior to entry by the entrant to ensure that it is safe.

By integrating atmospheric sensors with remote annunciation and telemetry onto the ladder, or any other device that facilitates entry, it would be impossible for an individual to enter into a confined space without the benefit of prior knowledge on the condition of the atmosphere. Even if the individual neglects to meter the atmosphere prior to entry, to ensure that it is safe, the atmospheric sensors on the entrance assembly that is inserted into the confined space will report on an unsafe atmosphere in advance of entry.

An application example would be as follows:

An operator needs to conduct a maintenance/repair operation inside of a truck carrier tank 900. The operator opens the batch covering the manway 910. This is when the atmosphere of the tank should be tested. If the atmosphere is not safe, then no further steps should be taken by the operator to enter the space. If the atmosphere is safe, entrance assembly 100 is used to allow the entrant to climb down into the confined space 900, in this example a tank, to conduct business. The entrance assembly 100 is stored on the wall in a horizontal position as shown in FIG. 2. The alarm status annunciator module, (ASAM) 200, is reading the active/dormant sensor 260 and indicates that the ladder is inactive or dormant.

The system integrity will be failsafe by incorporating several features to ensure that the system is operating within normal limits. The monitoring of the battery life for active/dormant sensor 260 to make sure that the battery is not close to its lower operational limit of charge. If the battery is low, then an alarm event will be triggered to notify the operator that the system needs attention and the battery should be replaced or recharged. The dormant mode can also indicate to the alarm status annunciator module, (ASAM) 200 that the gas sensor/meter 400 should be powered off. If gas sensor/meter 400 readings are still detected, then the operator has left the atmospheric meter/monitor powered on and will be draining the battery unnecessarily. The alarm status annunciator module, (ASAM) 200 can alert the operator to shut off the gas sensor/meter 400 to preserve battery life or the system could automatically shut off the necessary components not required in the dormant mode. The operator removes the entrance assembly 100 from its horizontal storage location and inserts it vertically into the open manway (entrance port 910) to allow access into the tank (confined space 900). The active/dormant sensor 260 now indicates that the ladder is in an operational configuration. The alarm status annunciator module, (ASAM) 200 will log the time and date that the entrance assembly 100 was placed in an operational configuration. When the entrance assembly 100 is placed in this position, the alarm status annunciator module, (ASAM) 200 will now try and communicate with the gas sensor/meter 400 on the end of the entrance assembly 100. If it cannot establish communications with the gas sensor/meter 400 it will go into an equipment failure alarm mode. This alarm will now alert the operator that no further action should be taken until the equipment is made operational. This may be a simple matter of turning on the gas sensor/meter 400 that was accidently left off, or changing a discharged battery. If communications are established the alarm status annunciator module, (ASAM) 200 will now monitor atmospheric conditions from the gas sensor/meter 400 and indicate safe conditions with a green annunciator light 210G. If data is returned that indicates an unsafe condition, the alarm status annunciator module, (ASAM) 200 will go into an alarm mode, sound a high decibel alarm 220 and activate the alarm light indicators 210R. If safety protocols dictate that an individual must test the atmosphere of the confined space before the entrance assembly 100 is inserted, then this alarm is an indication of a procedural error on the part of the employee and an accident was averted.

The alarm status annunciator module, (ASAM) 200 data can also be transmitted to a networked monitor 280 in the form of a PC console 280*a*, tablet 280*b* or mobile device (such as a smartphone 280*c* or wearable mobile device 280*d*, i.e., a smart watch) via a network where the status of multiple locations can be displayed. In some instances, it may be necessary to place a wireless repeater on the opposite end of the ladder to allow the wireless signal to be transmitted outside of the tank. This repeater would be incorporated into the alarm status annunciator module, (ASAM) 200 or active/dormant Module (ADM) 300. Remote antennas can also be used to allow proper signal strength and is received for all of the wireless information. See FIG. 7.

Other features could be integrated onto the ladder to increase its capability—such as a video camera 700 that can allow others to observe the entrant inside of the confined space, as well as illuminators or an integrated work light 600 that can serve to light up the space and allow an entrant to see.

If a safety protocol is adopted that the entrant must meter the atmosphere of the confined space prior to inserting the ladder, then the system alarm serves a dual function. If the entrance assembly 100 alarm initiates—it not only will alert the employee of the problem before entry and potentially save his life, it will also inform management that this individual has not tested the atmosphere in advance of entry as per established procedures. They will now be aware that this worker is operating in an unsafe manner that is not compliant with regulatory agency mandates and the employee's training. As a result of this procedural omission, the entrant is putting themselves and their employers at risk of potential negative consequences. Action can be taken by management in advance of an accident to mitigate a hazardous action by the employee with either retraining or termination.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

I claim:

1. A portable access system configured for temporary positioning in an entrance and exit port of a confined space to prevent access of a worker into life-threatening atmospheric confined space breathing conditions in the confined space, and to facilitate the worker's safe entrance into and exit from the confined space in reliance thereon, the portable access system comprising:

an entrance assembly having an insertion end that is temporarily inserted through said entrance port into said confined space, and a positioning end, opposite the insertion end, that remains outside the confined space when the insertion end is temporarily inserted into said confined space, said positioning end having means to support said entrance extending into said confined space in advance of worker entry therein;

a first sensor arranged on the insertion end for monitoring said confined space for a potential or actual dangerous, life-threatening breathing condition and generating a preemptive gas detection status signal to alert the worker's surrounding personnel and facilities managers overseeing the confined space of the potential or actual dangerous, life-threatening breathing conditions therein;

an alarm status annunciator module arranged mounted on the positioning end of said entrance assembly outside the entrance port in communication with the first sensor for receiving the preemptive gas detection status signal, said entrance assembly supports both said first sensor and said alarm status annunciator;

wherein upon receiving a preemptive gas detection status signal indicating that a potential or actual dangerous, life-threatening breathing condition exists in said confined space, whereby the alarm status annunciator module communicates a warning alarm signal and emits a first alarm to the worker's surrounding personnel and facilities managers that the potential or actual dangerous, life-threatening breathing condition exists within said confined space; and, a second sensor in said alarm status annunciator on said entrance assembly for monitoring the worker's movement within said confined space, and generating a movement monitoring signal for detecting a premature unsafe entry of a worker attempting to enter said confined space, without following predetermined critical safety procedures denying access during the potential or actual dangerous, life-threating breathing conditions within the confined space, and emitting a second alarm, whereby said first sensor and alarm status annunciator module, including said second sensor, are inserted together with said entrance assembly extending partially into said confined space;

wherein said second sensor emits the second alarm when a worker entry is attempted before said first sensor detects that the potential or actual dangerous life-threatening condition exists within said confined space.

2. The portable access system of claim 1, in which said alarm status annunciator module directs power to said first sensor and controls an on/off state of said first sensor.

3. The portable access system of claim 1, in which said first sensor is powered from and with a wired data connection to said alarm status annunciator module, said alarm status annunciator module functioning as a repeater of said gas detection status signal from within said confined space, allowing said gas detection status signal to be transmitted from the first sensor to the worker's surrounding personnel and facilities managers located outside of said confined space.

4. The portable access system of claim 1, in which said entrance assembly is a ladder.

5. The portable access system of claim 4, in which said insertion end comprises a lower leg portion of said ladder and in which said first sensor samples gas from the lower leg portion of said ladder.

6. The portable access system of claim 4, in which said status annunciator module is mounted proximate an upper leg portion of said ladder extending outside of said entrance port.

7. The portable access system of claim 1, in which said entrance assembly is a carrier for lowering said worker into and raising said worker out of said confined space.

8. The portable access system of claim 1, further comprising an active module positioned on the insertion end of said access assembly in which said sensor is located.

9. The portable access system of claim 8, wherein said active module communicates wirelessly with said alarm status annunciator module.

10. The portable access system of claim 1, in which a video camera and integrated light are mounted on said entrance assembly such that when said entrance assembly is positioned within said confined space, said video camera and integrated light also are positioned within said confined space.

11. The portable access system of claim 1, wherein said second sensor is selected from the group consisting of at least one of an optical sensor, a position switch, an ultrasonic sensor, a pressure sensor, a load sensor, a conduction sensor, a Hall Effect sensor and a piezo electric sensor, or combinations thereof.

12. The access system of claim 1, further comprising a monitoring station computer for receiving the warning signal of the potential or actual dangerous, life-threatening breathing condition within the confined space, from said annunciator module through a wireless interface and/or wired connection to provide alerts to a monitoring person of the worker's surrounding personnel and facilities managers located adjacent to, and outside of said confined space, said monitoring station computer running software that receives and interprets the warning signal of the potential or actual dangerous, life-threatening breathing condition within the confined space.

13. A method of assuring a worker's safe entry to, operation within and exit from a confined space, to prevent access to the worker into the confined space, in which a potential or actual dangerous, life-threatening breathing condition could exist, the method comprising the steps of:

temporarily inserting, through an entrance and exit port, an insertion end of entrance assembly into said confined space, such that a positioning end of the entrance assembly, opposite the insertion end, remains temporarily positioned outside said confined space in advance of worker entry therein, to enable the worker to enter and exit said confined space through said entry and exit port and to prevent the worker entry into the confined space during the potential or actual dangerous, life-threatening breathing conditions therein;

first monitoring atmospheric gas in said confined space, using a first sensor positioned on the insertion end of said entrance assembly, and transmitting a potential or actual dangerous, life-threatening breathing condition alarm signal emitting a first alarm to alert the worker's surrounding personnel and facilities managers overseeing the confined space of the potential or actual dangerous, life-threatening breathing conditions therein, the potential or actual dangerous, life-threatening breathing condition is detected by the first sensor;

in response to receiving said potential or actual dangerous, life-threatening breathing condition alarm signal from the first sensor, communicating a preemptive warning signal to the surrounding personnel and facilities managers of the confined space that the potential or actual dangerous, life-threatening breathing condition exists within said confined space, using an alarm status annunciator module mounted on said positioning end; and, a second sensor monitoring a worker's movement during attempted entry into, operation within and exit from said confined space, using said second sensor also mounted on said positioning end, and generating a corresponding worker movement monitoring signal and emitting a second alarm indicating worker attempted entry based on the second monitoring, whereby said first and second sensors and alarm status annunciator module are inserted all together with said entrance assembly partially extending into said confined space having the potential or actual dangerous life, threatening breathing condition therein, to prevent the worker entry therein and transmitting the worker attempted entry movement signal to the worker's surrounding personnel and facilities managers immediately upon the worker attempted entry, to preemptively prevent the worker's attempted entry into the confined space;

wherein further said second sensor emits said second alarm when the worker entry is attempted before said first sensor detects that the potential or actual dangerous, life-threatening breathing condition exists within the said confined space.

14. The method of claim 13, in which said alarm status annunciator module directs power to said first sensor and controls an on/off state of said first sensor.

15. The method of claim 13, in which said first sensor is powered from and with a wired data connection to said alarm status annunciator module, and functions as a repeater of said dangerous, life-threatening breathing condition alarm signal from within said confined space, allowing said dangerous life threatening breathing condition alarm signal to be transmitted from said confined space to the worker's surrounding personnel and facilities managers located adjacent to and outside of said confined space.

16. The method of claim 13, in which said entrance assembly is a ladder.

17. The method of claim 16, in which said insertion end of said ladder comprises a lower leg portion and in which said first sensor samples gas from the lower leg portion of said ladder.

18. The method of claim 16, in which said alarm status annunciator module is mounted proximate an upper leg portion of said ladder extending outside of said entry and exit port.

19. The method of claim 13, in which said entrance assembly is a carrier for lowering said worker into said confined space.

20. The method of claim 13, further comprising an active module positioned on the insertion end of said entrance assembly.

21. The method of claim 20, wherein said active module communicates wirelessly with said alarm status annunciator module.

22. The method of claim 13, in which a video camera and integrated light are mounted on said entrance assembly such that when said entrance assembly is positioned within said confined space, said video camera and integrated light also are positioned within said confined space to display the interior of said confined space before worker entry therein.

23. The method of claim 13, wherein said second sensor is selected from the group consisting of at least one of an optical sensor, a position switch, an ultrasonic sensor, a pressure sensor, a load sensor, a conduction sensor, a Hall Effect sensor and a piezo electric sensor, or combinations thereof.

24. The method of claim 13, in which a monitoring station computer receives said warning signal of the potential or actual dangerous, life-threatening breathing condition within the confined space, from said annunciator module through a wireless interface and/or wired connection to provide alerts to a monitoring person of the worker's surrounding personnel and facilities managers located adjacent to and outside of said confined space.

* * * * *